US007914879B2

(12) United States Patent
Cao et al.

(10) Patent No.: US 7,914,879 B2
(45) Date of Patent: Mar. 29, 2011

(54) THICK FUSING BELT FOR A COLOR ELECTROPHOTOGRAPHIC PRINTER

(75) Inventors: Jichang Cao, Lexington, KY (US); Scott Shiaoshin Wu, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 267 days.

(21) Appl. No.: 12/344,833

(22) Filed: Dec. 29, 2008

(65) Prior Publication Data

US 2010/0167065 A1 Jul. 1, 2010

(51) Int. Cl.
*B41M 5/00* (2006.01)
*B44C 1/17* (2006.01)
*G03G 7/00* (2006.01)

(52) U.S. Cl. ..... 428/195.1; 428/606; 428/935; 399/333; 205/73; 205/77

(58) Field of Classification Search ..... 428/195.1, 428/606, 935; 399/333; 205/73, 77
See application file for complete search history.

(56) References Cited

U.S. PATENT DOCUMENTS

2002/0057934 A1* 5/2002 Ishikawa et al. ..... 399/328
2005/0100373 A1* 5/2005 Kishino et al. ..... 399/329
2006/0067752 A1* 3/2006 Cao et al. ..... 399/329

* cited by examiner

*Primary Examiner* — Betelhem Shewareged

(57) ABSTRACT

An endless fusing thick belt for an electrographic imaging device having a flexible tubular configuration of predetermined diameter, said endless fusing thick belt comprising; an outside surface toner release layer comprised of a coating and a sleeve; a silicone rubber layer positioned inside said outside surface toner release layer; a rigid material layer positioned inside said silicone rubber layer; and a silicone base layer positioned inside and affixed to the internal surface of said polyimide layer using an adhesive.

19 Claims, 2 Drawing Sheets

THICK FUSING BELT FOR A COLOR ELECTROPHOTOGRAPHIC PRINTER

CROSS REFERENCES TO RELATED APPLICATIONS

None.

BACKGROUND

1. Field of the Invention

The present invention relates generally to electrophotographic imaging device and, more particularly, to a thick fusing belt of a fuser of electrophotographic imaging devices.

2. Description of the Related Art

In the electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to the media intended to receive the final permanent image. The toner is fixed to the media by the application of heat and pressure in a fuser. A fuser may include a heated roll and a backup roll forming a fusing nip through which media passes, known as a hot roll fuser. A fuser may also include a fuser belt and an opposing backup member, such as a backup roll, known as a belt fuser.

A hot roll fuser is a high force and pressure fuser that can deliver high print quality, however a hot roll fuser is not an instant on fuser due to the huge thermal mass of thick metal core and thick silicone rubber layer coated on the metal core. While a belt fuser with a ceramic heater or induction heater can be instant on, it is usually only used for low speed color laser printers as its fusing quality is not as good as that of a hot roll fuser.

In order to achieve a very short warm-up time, an instant on fuser, like a belt fuser with a ceramic or induction heater, uses an endless fusing belt that can be heated very fast due to its small thermal mass. Since the fusing belt is very thin and flexible, force cannot be directly applied to both ends of the belt to form a required fuser nip. To form a fuser nip, a stationary pressure member, a heater and a heater housing with a steel bracket for a ceramic belt fuser is put inside the belt tube. Forces are applied to both ends of the steel bracket and the pressure member forces the fusing belt to firmly contact against a backup roll to form a fuser nip. The pressure member is fixed and not turning. Since the pressure member is not turning with the belt, friction forces between the contact surfaces of the belt and the pressure member is very high and can wear the belt and reduce belt lifetime. Even with lubrication between the contact surface of the belt and the stationary pressure member, belt stall still occurs as the lubrication dries out. In order to reduce the friction force, the force used for forming a fusing nip has to be much lower than the force applied to a hot roll fuser. The lower force results in lower nip pressure and the lower nip pressure can cause many print quality problems, such as poor fuse grade, mottling, poor uniformity across a page, and transparency defects.

Based on the experience of a hot roll fuser and a belt fuser with a ceramic heater or induction heater, the depth of the fuser nip indentation must be kept small enough to allow the toner to release while the fuser nip size must be large enough for high speed fusing. Generally, in order to achieve a larger fuser nip size with a smaller fuser nip indentation, the size of the fuser must be increased, which necessarily increases the fuser warm up time significantly.

Thus, there is still a need for a fuser with fast warm up time, high force and pressure in order to deliver high print quality. Additionally, the fuser must have a flat or slightly dented fuser nip with a large enough fuser nip to achieve high speed fusing without increasing the fuser size.

SUMMARY OF THE INVENTION

The present invention meets this need by providing a fuser that combines the advantages of a belt fuser and a hot roll fuser and overcomes the disadvantages of low pressure or slow warm up times. The fuser provides higher fusing quality than that of a belt fuser with a ceramic heater due to a wider fusing nip, higher force/higher nip pressure, and a lower friction force. The fuser also provides a fusing nip large enough to achieve high speed fusing while minimizing the fuser nip indentation in order to allow the toner to release adequately to achieve higher fusing quality.

Accordingly, in an aspect of the present invention, a quartz-tube fuser having an endless fusing thick belt for an electrographic imaging device having a flexible tubular configuration of predetermined diameter is disclosed. The endless fusing thick belt includes an outside surface toner release layer made of a coating and a sleeve; a silicone rubber layer positioned inside said outside surface toner release layer; a steel layer positioned inside the silicone rubber layer; and a silicone base layer positioned inside and affixed to the internal surface of the steel layer using an adhesive.

In another aspect of the present invention, a quartz-tube fuser having an endless fusing thick belt for an electrographic imaging device having a flexible tubular configuration of predetermined diameter is disclosed. The endless fusing thick belt includes an outside surface toner release layer comprised of a coating or a sleeve; a silicone rubber layer positioned inside the outside surface toner release layer; a polyimide layer positioned inside the silicone rubber layer; and a silicone base layer positioned inside and affixed to the internal surface of the polyimide layer using an adhesive.

BRIEF DESCRIPTION OF THE DRAWINGS

Figure 1:
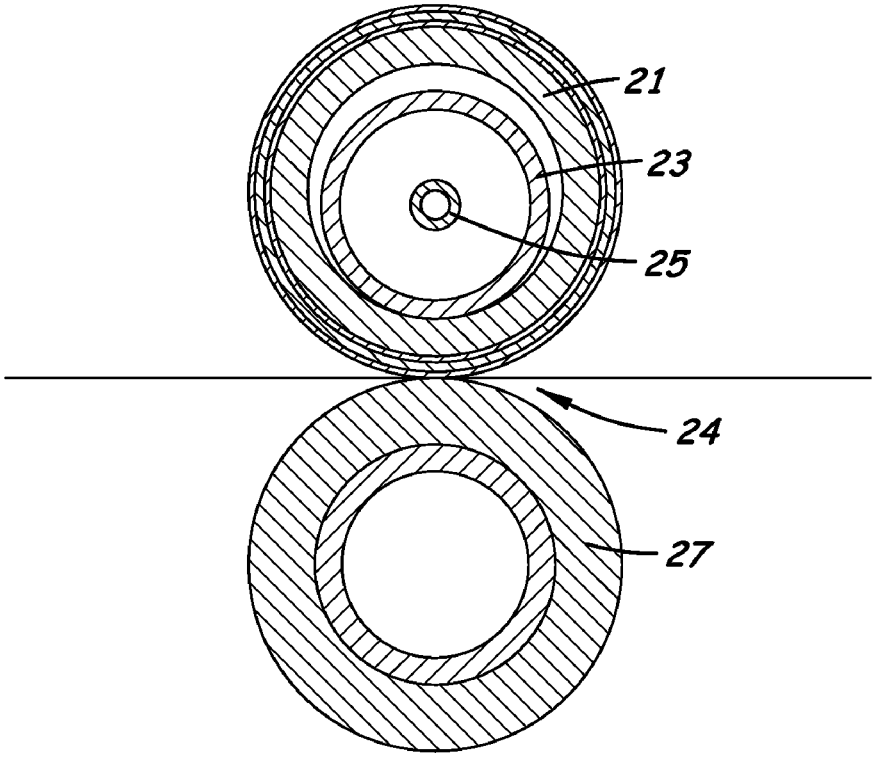

Having thus described the invention in general terms, reference will now be made to the accompanying drawings, which are not necessarily drawn to scale, and wherein:

FIG. 1 is a side view of the quartz-tube belt fuser with a flat fuser nip of the present invention.

Figure 2:
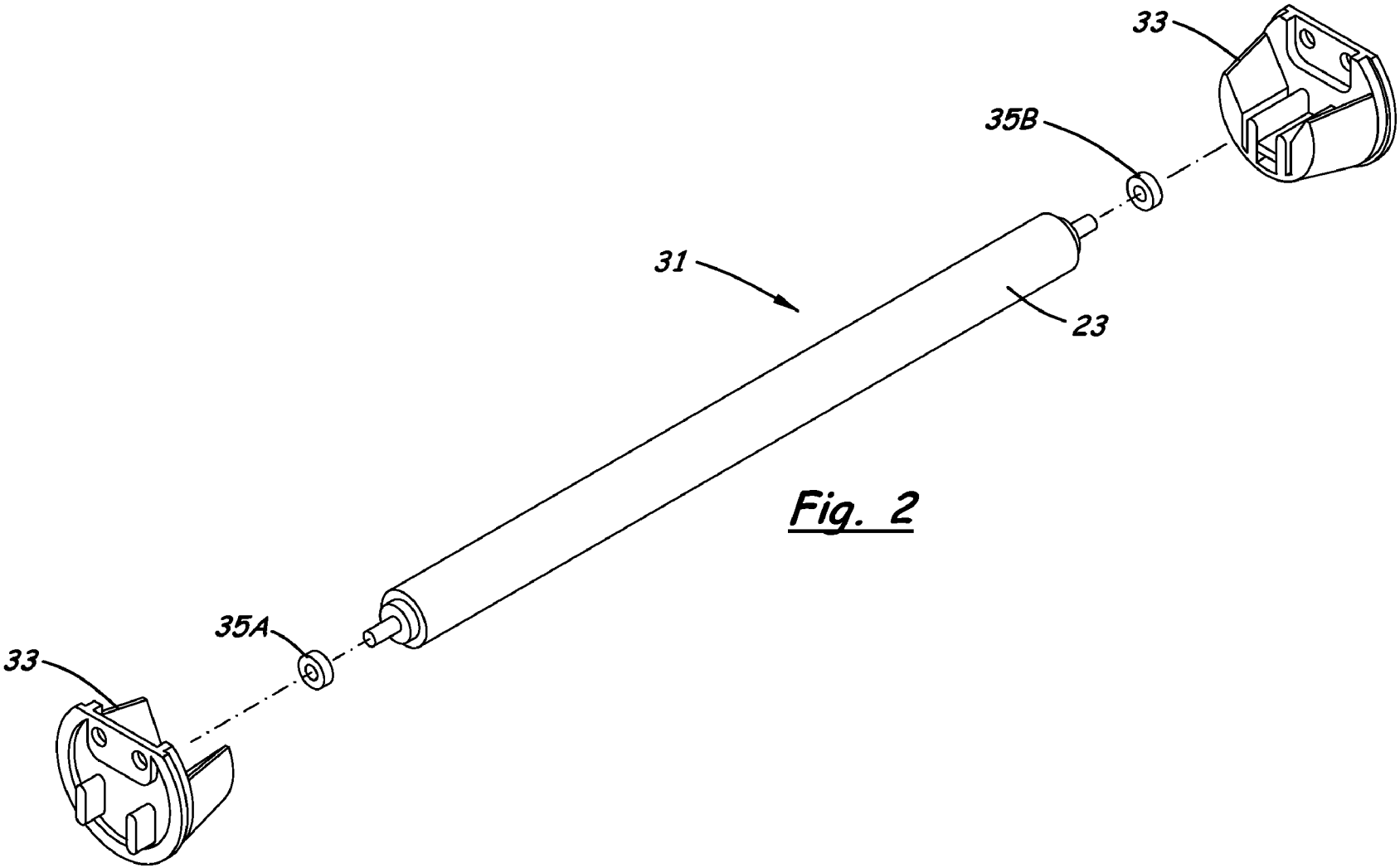

FIG. 2 is an exploded view of the quartz-tube support assembly of the present invention.

Figure 3:
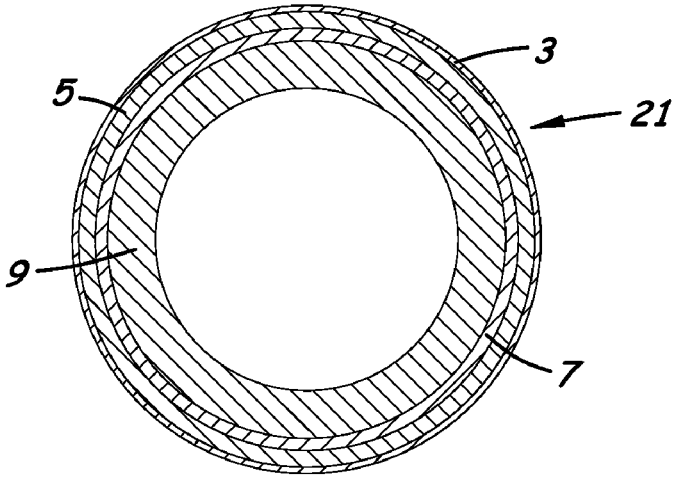

FIG. 3 is an expanded view of the thick fusing belt of the quartz-tube belt fuser in FIG. 1.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIG. 1, there is illustrated a side view of the quartz-tube belt fuser of the present invention. A lamp heater 25 serves as a heating source and is positioned inside a quartz tube 23, which has an elongated tubular body of predetermined diameter and a pair of opposite ends, with the tubular body being substantially transparent to allow the passage of radiant heat from the lamp heater 25. An endless fusing belt 21 having a flexible tubular configuration of predetermined diameter is positioned about the lamp heater 25 and spaced outwardly from the lamp heater 25. The quartz tube 23 is positioned around the lamp heater 25 and inside the fusing belt 21 and enables transmission of radiant heat from the lamp heater 25 to the fusing belt 21 to heat the fusing belt 21. The quartz tube 23 is seated upon a quartz-tube support assembly (not shown). A pressure roll 27 is positioned in opposition to the length-wise segment of the fusing belt 21 and to the quartz tube 23 contained within the fusing belt 21. Pressure is applied by the quartz tube 23 on the length-wise segment of the fusing belt 21 such that the fusing belt 21 and said pressure roll 27 form a fuser nip 29.

The quartz tube 23 must have above 90% transparency to the IR lamp emission spectrum of the lamp heater 25. The quartz tube 23 is used as a pressure member and can be stationary or rotational. The quartz tube 23 diameter must be smaller than the diameter of the fusing belt 21 in order to assure that the firm contact area between the fusing belt 21 and the quartz tube 23 only occurs at the fuser nip 29. The diameters of the fusing belt 21 and the quartz tube 23 are selected in order to make the contact area of the fusing belt 21 and the quartz tube 23 as small as possible. The diameter of the quartz tube 23 can be determined first based on fuser nip size requirements or residence time requirement. Then based on the determined quartz tube size, the diameter of the fusing belt 21 can be selected by minimizing the fusing belt diameter to minimize the thermal mass of the belt and maximizing the fusing belt diameter to minimize the contact area of the fusing belt 21 and the quartz tube 23. As a result, the thermal mass of the belt and the heat conducted to the quartz tube from the belt are minimized. Since the quartz tube 23 is transparent enough to allow 90% of the radiant heat generated by the lamp heater 25 to pass through the quartz tube 23 to heat the fusing belt 21 directly, the warm-up time of the belt from room temperature to its fusing temperature is minimized.

Referring now to FIG. 2, there is illustrated an exploded view of the quartz-tube support assembly of the present invention. A quartz tube support assembly 31 has a frame 33 and a pair of bearings 35A and 35B mounted on the frame 33 spaced apart from one another and supporting the quartz tube 23 at said opposite ends of the tubular body such that the tubular body of the quartz tube 23 is positioned around the lamp heater (not shown) and inside the fusing belt (not shown) and enables transmission of radiant heat generated by the lamp heater to fusing belt to heat the fusing belt. The quartz tube support assembly 32 is adapted to apply a force via the bearings 35A and 35B to the quartz tube 23 such that the quartz tube 23 applies pressure contact to the fusing belt along a length-wise segment of the fusing belt. Since the quartz tube 23 is seated on the ball bearings 35A and 35B at both ends, the friction torque is significantly lower than that of the prior art belt fusers shown in FIGS. 1 and 2 that have stationary pressure members. Therefore, the quartz tube 23 can take a high load to generate enough nip pressure for printing quality without causing high torque and belt stall issues.

Referring now to FIG. 3, there is illustrated an expanded view of the endless fusing belt 21. The endless fusing belt 21 has an outside surface toner release layer 3 which can be made from a coating and a sleeve and can vary in thickness from about 20 to about 50 microns. A silicone rubber layer 5 that provides better compliance and better fusing quality is positioned inside the toner release layer 3. The silicone rubber layer 5 can be made out of high thermal conductive rubber and can vary in thickness from about 200 to about 500 microns. A rigid material layer 7 is positioned inside the silicone rubber layer 5. The rigid material layer 7 can be made from steel of about 50 microns in thickness or polyimide of thickness from about 50 to about 250 microns. If the rigid material layer 7 is made from polyimide, both filled and unfilled. An unfilled polyimide with natural amber color is preferred which has very low infrared absorption, so that the infrared energy from the lamp heater can pass through the polyimide layer and directly heat the silicone rubber layer 5. A silicone base layer 9 is positioned inside and affixed to the internal surface of the rigid material layer 7 layer using an adhesive or primer (not shown). The silicone base layer 9 must have a very low IR absorption so that less IR energy is absorbed by the silicone base layer 9 and more IR energy can pass through the silicone base layer 9 and directly heat the rigid material layer 7, silicone rubber layer 5 and outside surface toner release layer 3 of the thick fusing belt. As a result, the silicone base layer 9 material is from translucent silicone foam, light color silicone foam, transparent silicone rubber, translucent silicone rubber, or other suitable low IR energy absorption material. The silicone base layer 9 is from about 1 mm to about 2.5 mm in thickness and from about 2 to about 40 shore A in hardness.

Since the belt is thick and flexible, it can easily form a slightly indented, flat, or reversed nip by adjusting the thickness, hardness, or both of the foam or rubber base layer. By this way, toner release problem of a quartz tube belt fuser can be easily fixed. Since the most IR energy emitted by a lamp can easily pass through quartz tube and the base foam or rubber layer to heat the outside layer directly, the surface temperature of the thick belt can be warmed up to fusing temperature within a very short time.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. An endless fusing thick belt for an electrographic imaging device having a flexible tubular configuration of predetermined diameter, said endless fusing thick belt comprising;

an outside surface toner release layer comprised of a coating and a sleeve;

a silicone rubber layer positioned inside said outside surface toner release layer;

a steel layer positioned inside said silicone rubber layer; and a silicone base layer positioned inside and affixed to the internal surface of said steel layer using an adhesive material.

2. The endless fusing thick belt of claim 1 wherein said outside surface layer is from about 20 to about 50 microns in thickness.

3. The endless fusing thick belt of claim 1 wherein said silicone rubber layer material is selected from the group consisting of black rubber or other suitable material having an IR energy absorption similar to black rubber.

4. The endless fusing thick belt of claim 3 wherein said silicone rubber layer material is from about 200 to about 500 microns in thickness.

5. The endless fusing thick belt of claim 1 wherein said steel layer is about 50 microns in thickness.

6. The endless fusing thick belt of claim 1 wherein said silicone base layer material is selected from the group consisting of translucent silicone foam, light color silicone foam, transparent silicone rubber, translucent silicone rubber, or other suitable low IR energy absorption material.

7. The endless fusing thick belt of claim 6 wherein said silicone base layer is from about 2 to about 40 shore A in hardness.

8. The endless fusing thick belt of claim 7 wherein said silicone base layer is from about 1 mm to about 2.5 mm in thickness.

9. An endless fusing thick belt for an electrographic imaging device having a flexible tubular configuration of predetermined diameter, said endless fusing thick belt comprising;

an outside surface toner release layer comprised of a coating and a sleeve;

a silicone rubber layer positioned inside said outside surface toner release layer;

a polyimide layer positioned inside said silicone rubber layer; and a silicone base layer positioned inside and affixed to the internal surface of said polyimide layer using an adhesive material.

10. The endless fusing thick belt of claim 9 wherein said outside surface layer is from about 20 to about 50 microns in thickness.

11. The endless fusing thick belt of claim 9 wherein said silicone rubber layer material is selected from the group consisting of black rubber, or other suitable material having an IR energy absorption similar to black rubber.

12. The endless fusing thick belt of claim 11 wherein said silicone rubber layer material is from about 200 to about 500 microns in thickness.

13. The endless fusing thick belt of claim 9 wherein said polyimide layer is from about 50 to about 200 microns in thickness.

14. The endless fusing thick belt of claim 9 wherein said polyimide layer is made from unfilled polyimide.

15. The endless fusing thick belt of claim 9 wherein said polyimide layer is made from filled polyimide.

16. The endless fusing thick belt of claim 14 wherein said polyimide layer is from about 50 to about 200 microns in thickness.

17. The endless fusing thick belt of claim 9 wherein said silicone base layer material is selected from the group consisting of translucent silicone foam, light color silicone foam, transparent silicone rubber, translucent silicone rubber, or other suitable low IR energy absorption material.

18. The endless fusing thick belt of claim 9 wherein said silicone base layer is from about 2 to about 40 shore A in hardness.

19. The endless fusing thick belt of claim 18 wherein said silicone base layer is from about 1 mm to about 2.5 mm in thickness.

* * * * *